US007207369B2

(12) United States Patent
Weddell

(10) Patent No.: US 7,207,369 B2
(45) Date of Patent: Apr. 24, 2007

(54) WINDOW AWNING MOUNTING SYSTEM

(75) Inventor: Vince Weddell, Irvine, CA (US)

(73) Assignee: Girard Systems, San Clemente, CA (US)

( * ) Notice: Subject to any disclaimer, the term of this patent is extended or adjusted under 35 U.S.C. 154(b) by 274 days.

(21) Appl. No.: 10/974,086

(22) Filed: Oct. 27, 2004

(65) Prior Publication Data

US 2006/0086466 A1 Apr. 27, 2006

(51) Int. Cl.
*E04F 10/00* (2006.01)

(52) U.S. Cl. ..... 160/22; 160/66

(58) Field of Classification Search ..... 160/22, 160/66, 67, 69, 903; 135/88.11, 88.12
See application file for complete search history.

(56) References Cited

U.S. PATENT DOCUMENTS 1,620,958 A * 3/1927 Girton et al. ..... 160/65
1,905,339 A * 4/1933 Brown ..... 160/22
3,324,869 A * 6/1967 Duda ..... 135/88.12
3,722,571 A * 3/1973 Knight et al. ..... 160/68
3,918,511 A * 11/1975 Upton, Jr. ..... 160/67
5,016,699 A * 5/1991 Akers et al. ..... 160/22
6,792,993 B1 * 9/2004 Forbes ..... 160/67

* cited by examiner

*Primary Examiner*—David Purol
(74) *Attorney, Agent, or Firm*—Walter A. Hackler

(57) ABSTRACT

A window awning mounting system suitable for a non-planar surface includes a housing containing a roll of awning. A forearm is provided and includes a header at one end thereof attached to a leading edge of the roll up awning. A bracket mounted on the non-planar surface is provided for securing and stabilizing one end of the forearm. A spring loaded tension arm having one end attached to the forearm is provided and an arm bracket, which is separate from the housing bracket, pivotally attaches both a second end of the forearm and a second end of the tension arm.

3 Claims, 2 Drawing Sheets

WINDOW AWNING MOUNTING SYSTEM

The invention generally relates to window awnings and is more particularly directed to self-storing awning assemblies suitable for attachment to recreational vehicles and the like.

A popular accessory for recreational vehicles is an extendable awning, which provides for sheltered areas when in an extended position during stationary use of the recreational vehicle. Such awnings are retracted into a housing or case for storage during transit.

Heretofore, many roll up window awnings have typically included a roll tube/fabric assembly and two side arm assemblies with the fabric extended and retractably stored in a box or housing by means of either a motor driven or manually turned roller tube.

The side arm assemblies typically include a mounting bar which attaches the system to a vertical mounting surface, a tensioning arm, which is a spring loaded, then imparts an outward force on a forearm. The forearm which is fastened by a pivot to the mounting bar and a lead rail, holds a far end of the fabric in a taut manner.

This system is suitable for mounting to a flat vertical surface, however, for vehicles with non-vertical, or curved, outside surfaces, a single piece mounting bar produces unsightly gaps between the bar and the vehicle side, which also produces substantial wind noise when the vehicle is in motion.

Heretofore, this mounting bar has been utilized for both housing a sliding, spring-load pivot joint and, in addition, providing axial restraint when the awning is stowed away, which is important when the vehicle is subjected to high wind velocities during transport.

The present mounting assembly overcomes the disadvantages of the prior art and provides for a more streamlined and cleaner appearing installation in addition to substantially reducing wind noise during transit.

SUMMARY OF THE INVENTION

A window awning mounting system suitable for non-planar surfaces in accordance with the present invention generally includes a housing containing a roll up awning along with a housing bracket mounting the awning to a non-planar surface.

A forearm is provided which includes a header at one end thereof attached to a leading edge of the roll up awning.

Further, a spring loaded tension arm includes one end attached to the forearm and an arm bracket and is separate from the housing bracket. This arm bracket is utilized for pivotally attaching both the second end of the forearm and the second end of the tension arm.

Preferably, the one end of the tension arm is slidably attached proximate the header and the housing bracket removably receives and stabilizes the one end of the tension arm when the awning is in a retracted position for providing axial support during transport.

In another embodiment of the present invention, fittings may be provided and disposed on the non-planar surface and the tension arm for removably securing the tension arm to the non-planar surface.

Such fittings may include a receptacle and a non-planar surface and a pin disposed in the tension arm. Preferably, the pin is disposed proximate the one end of the tension arm.

BRIEF DESCRIPTION OF THE DRAWINGS

A more complete understanding of the invention may be head by reference to the following description when taken into conjunction with the accompanying drawings in which.

DETAILED DESCRIPTION

Figure 1:
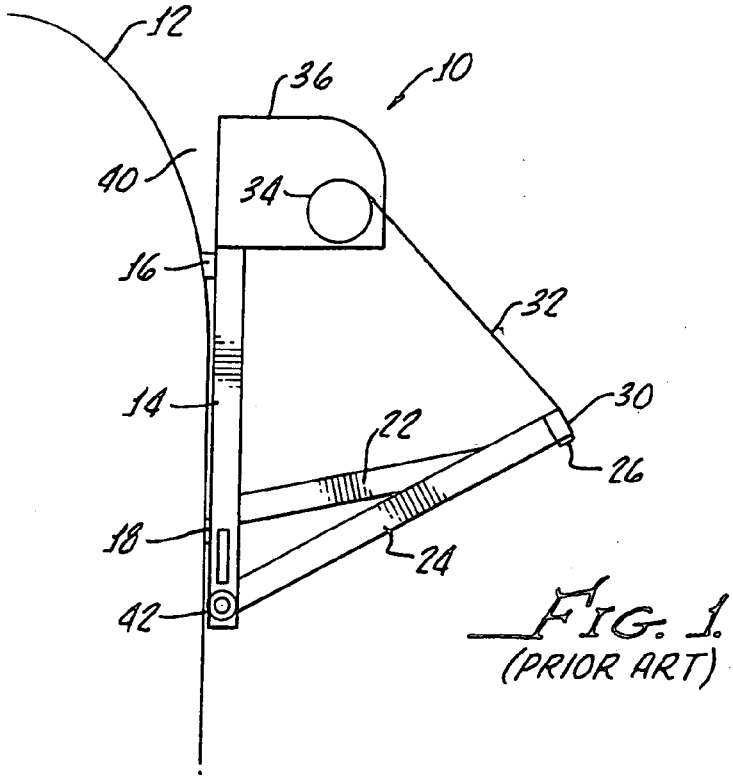
FIG. 1. (PRIOR ART)
FIG. 1 is a side view diagram of a prior art window awning mounting system installed on a non-planar surface and illustrating large gaps developed upon such installation.

With reference to FIG. 1, there is shown a prior art mounting system 10 as installed on a non-planar, or curved, vehicle surface 12 and generally including a mounting bar 14 attached to the surface 12 by brackets 16, 18 and further including a spring loaded tensioning arm 22, a forearm 24, and a lead rail 26 attached to a far end 30 of fabric 32 unwound from a roll 34 disposed in a housing 36.

While shown in an exaggerated fashion, this mounting system 10 produces large gaps 40, 42 between the mounting bar 14 and the surface 12 which are not only unsightly but as hereinbefore noted, are producers of unacceptable wind noise when the vehicle surface 12 is in motion.

Figure 2:
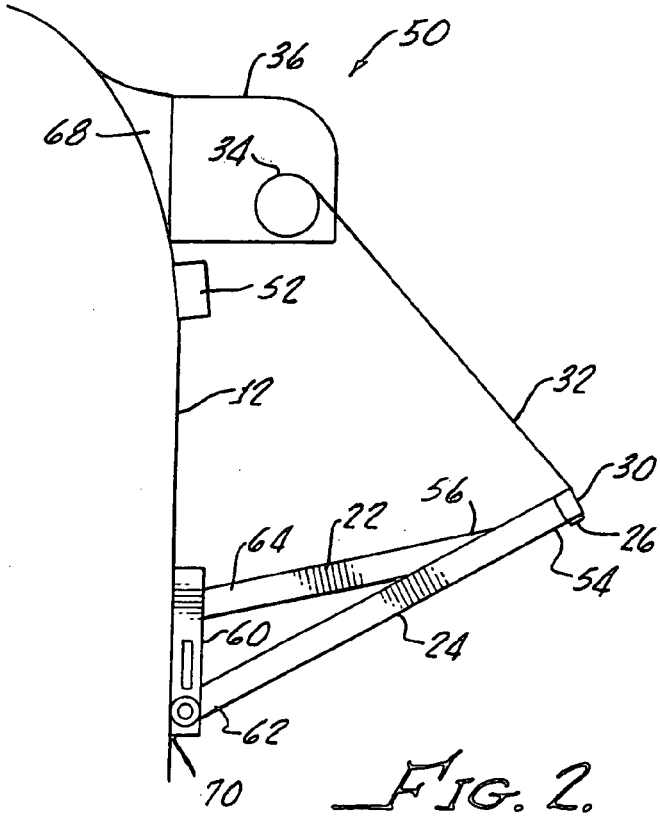
FIG. 2 is a side view diagram of a window awning mounting system in accordance with the present invention shown installed on a non-planar surface and illustrating smaller more manageable gaps which provide a more streamlined and cleaner appearing installation as well as less wind resistance and noise compared to the prior art mounting system illustrated in FIG. 1.

With reference now to FIG. 2, there is shown a window awning mounting system 50 in accordance with the present invention suitable for a non-planar surface 12, common reference numbers indicating identical or substantially similar elements, as hereinabove described in connection with the prior art system shown in FIG. 1. The mounting system 50 includes a 52. A separate support, not shown and not part of the present invention, may be provided for mounting the housing 36 to the non-planar surface 12.

As shown, the forearm 24 includes one end 54 attached to the lead rail 26 and far end, or leading edge, of the awning fabric 32. The spring loaded tension arm 22 includes one end 56 attached to the forearm 24 proximate the lead rail, or header 26.

The present invention 50 provides for an arm bracket 60 separate and spaced apart from the bracket 52, which pivotally attaches both a second end 62 of the forearm 24 and a second end 64 of the tension end 22.

Figure 3:
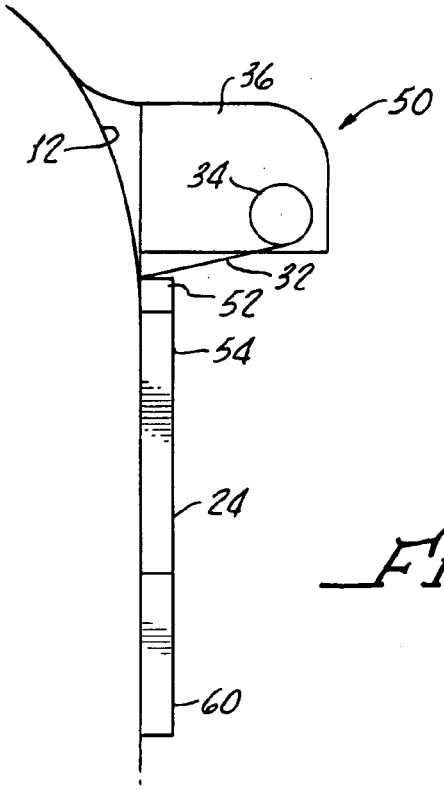
FIG. 3 is a side view diagram of the system shown in FIG. 2 with the forearm and tension arm retracted and stabilized by a housing bracket.

With reference to FIG. 3, there is shown the mounting system 50 wherein the forearm 24 and tension arm 22 is in a retracted position and the bracket 52 receives and stabilizes the one end 54 of the forearm 24. It should be appreciated that the bracket 52 and arm brackets 60 may be in disposed at an angle to the forearm 24, as shown in the figures, thus substantially reducing gaps 68, 70 between the housing 36 and surface 12 and between the arm brackets 60 and the surface 12, as shown in FIGS. 2 and 3. Again, the gaps 68, 70 are exaggerated for illustration but are small compared to gaps 40, 42 existent with the prior art 10.

Figure 4:
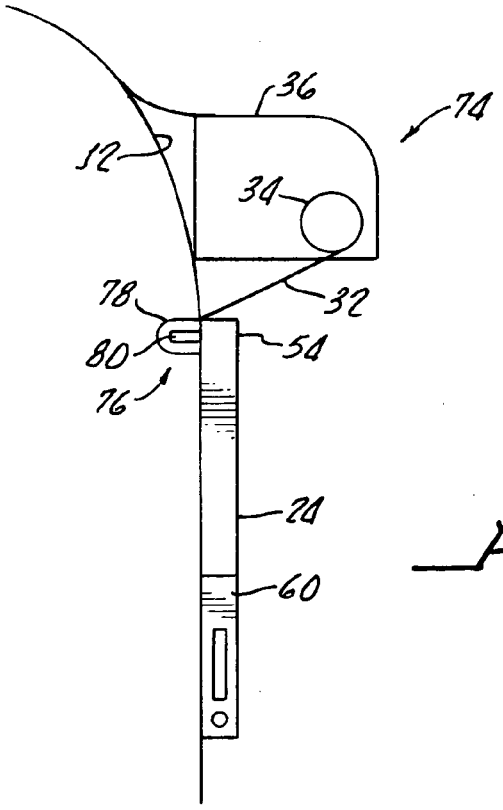
FIG. 4 is an alternative embodiment of the present invention in which fittings are provided for stabilizing the forearm and tensioning arm, as will be hereinafter discussed in greater detail.

An alternative embodiment 74 for mounting the system in accordance with the present invention as shown in FIG. 4 with common reference characters representing identical or substantially similar elements as hereinabove described in connection with the embodiment 50 shown in FIGS. 2–3. In this embodiment, fittings 76 are provided for removably securing the forearm 24 to the non-planar surface 12 and may include a receptacle 78 disposed in the non-planar surface 12 and a pin 80 disposed proximate the one end 54 of the forearm 24. Accordingly, in this embodiment, the fittings 76 stabilize the one end 54 of the forearm 24 during transit.

Although there has been hereinabove described a specific window awning mounting system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A window awning mounting system for a non-planar surface comprising:

a housing;

a forearm including a header to one end thereof attaching a rollup awning leading edge;

a fastener for removably securing the forearm to said non-planar surface, said fastener including a receptacle formed in and below said non-planar surface and a pin disposed on said forearm;

a spring loaded tension arm having one end slidably attached to said forearm; and an arm bracket, separate from the bracket and pivotably attaching both a second end of said forearm and a second end of the tension arm.

2. The system according to claim 1 wherein the one end of the forearm is attached proximate said header.

3. The system according to claim 1 wherein said pin is disposed proximate said one end of the forearm.

* * * * *